US007836858B2

(12) United States Patent
Maehara et al.

(10) Patent No.: US 7,836,858 B2
(45) Date of Patent: Nov. 23, 2010

(54) V-TYPE ENGINE AND MOTORCYCLE INCORPORATING SAME

(75) Inventors: Hayato Maehara, Saitama (JP); Shinji Saito, Saitama (JP); Takaaki Tsukui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 429 days.

(21) Appl. No.: 12/079,347

(22) Filed: Mar. 26, 2008

(65) Prior Publication Data

US 2008/0236522 A1 Oct. 2, 2008

(30) Foreign Application Priority Data

Mar. 30, 2007 (JP) ..... 2007-095691

(51) Int. Cl.
*F01L 1/34* (2006.01)

(52) U.S. Cl. ..... 123/90.16; 123/90.27; 123/90.39; 123/193.5

(58) Field of Classification Search ..... 123/90.16, 123/90.27, 90.31, 90.39, 90.44, 193.3, 193.5
See application file for complete search history.

(56) References Cited

U.S. PATENT DOCUMENTS 6,318,316 B1 11/2001 Tsukui et al.
7,188,600 B1 3/2007 Maehara et al.
7,210,454 B2 5/2007 Maehara et al.
7,669,562 B2 * 3/2010 Maehara et al. ..... 123/90.12

FOREIGN PATENT DOCUMENTS

| | | |
|---|---|---|
| JP | 2000-205038 | 7/2000 |
| JP | 2000-303850 | 10/2000 |
| JP | 2002-180812 | 6/2002 |
| JP | 2005-090463 | 4/2005 |
| JP | 2006-283578 | 10/2006 |

* cited by examiner

*Primary Examiner*—Ching Chang
(74) *Attorney, Agent, or Firm*—Carrier Blackman & Associates PC; William D. Blackman; Joseph P. Carrier

(57) ABSTRACT

A V-type vehicle engine includes a main engine body with a front bank with a rear bank defining a V-type structure. A plurality of valve actuation units are respectively located in valve chambers in the front bank and the rear bank, to minimize the size of a cylinder head and a cylinder head cover in at least one of the front bank and the rear bank. A first valve actuation unit, with a double overhead camshaft structure having intake-side and exhaust-side camshafts individually corresponding to the intake valve and the exhaust valve, is located in a valve chamber in one of the front bank and the rear bank. A second valve actuation unit, having a common single camshaft for the intake valve and the exhaust valve, is located in a valve chamber in the other one of the front bank and the rear bank.

20 Claims, 9 Drawing Sheets

V-TYPE ENGINE AND MOTORCYCLE INCORPORATING SAME

CROSS REFERENCE TO RELATED APPLICATIONS

This application claims the benefit under 35 USC 119 of Japanese Application No. 2007-095691, filed 30 Mar. 2007, and the entire subject matter of this priority document, including specification, claims and drawings, is incorporated by reference herein.

BACKGROUND OF THE INVENTION

1. Field of the Invention

The present invention relates to a V-type engine for a vehicle, in which a main engine body having a front bank and a rear bank forms a V-shape in a longitudinal direction of the vehicle. More particularly, the present invention relates to a V-type engine which includes valve actuation units to actuate an intake valve and an exhaust valve that are respectively located in valve chambers in the front bank and the rear bank.

2. Background Art

A V-type engine mounted on a motorcycle, in which valve actuation units for a front bank and a rear bank each have a double overhead camshaft (DOHC) structure, is disclosed in Japanese Patent JP-A 2000-303850. In the motorcycle engine disclosed in this reference, a comparatively large space is required in the valve chamber formed between the cylinder head and the cylinder head cover, in order to accommodate the two camshafts of the DOHC type valve actuation units and cam chains, sprockets, gears and related hardware needed to drive these camshafts, and as a result, the cylinder head and the cylinder head cover are made larger.

Accordingly, in a V-type engine having front and rear banks, when the angle between the banks is widened, the length from the front end of the front bank to the rear end of the rear bank is extended, and along with the need for space to accommodate other vehicle constituent elements, the longitudinal length of the vehicle is extended.

Alternatively, when the angle between the banks is narrowed, the main engine body is made larger in the vertical direction, due to the increased size of the cylinder head and the cylinder head cover. Accordingly, in this arrangement, an air cleaner and a fuel tank, normally provided above the main engine body, are provided in separate locations where there is available space. Thus, it would be necessary to have the vehicle made larger in the vertical direction.

SUMMARY OF THE INVENTION

In view of the above-described problems, it is an object of the present invention to provide a V-type engine for a vehicle, in which the cylinder head and the cylinder head cover can be made smaller in one of the front bank and the rear bank.

According to a first aspect of the invention, a main engine body is provided with a front bank and a rear bank forming a V-shape in a longitudinal direction of a vehicle having a V-type structure, and valve actuation units actuate intake valves and exhaust valves located in valve chambers of the front bank and the rear bank. In the engine according to the first aspect, a first valve actuation unit is located in the valve chamber in one of the front bank and the rear bank, and this first valve actuation unit includes a double overhead camshaft structure having separate intake-side and exhaust-side camshafts individually corresponding to the intake valve and the exhaust valve. Also in the engine according to the first aspect, a second valve actuation unit is located in the valve chamber in the other one of the front bank and the rear bank, the second valve actuation unit having a common single camshaft for actuating both the intake valve and the exhaust valve.

It is a second aspect of the invention to provide the second valve actuation unit located in the valve chamber of the front bank, and the first valve actuation unit in the valve chamber of the rear bank.

It is a third aspect of the invention to provide the first valve actuation unit located in the valve chamber of the front bank, and the second valve actuation unit in the valve chamber of the rear bank.

It is a fourth aspect of the invention to provide the first valve actuation unit with an intake-side valve lifter slidably engaged with the cylinder head between the intake valve and the intake-side camshaft, so as to reciprocate in accordance with rotation of the intake-side camshaft, and an exhaust-side valve lifter slidably engaged with the cylinder head between the exhaust valve and the exhaust-side camshaft so as to reciprocate in accordance with rotation of the exhaust-side camshaft, and a valve rest mechanism, that holds at least one of the intake valve and the exhaust valve in a valve-close rest state in correspondence with a running status of the vehicle, is provided in the valve lifter on the side held in the valve-close rest state.

It is a fifth aspect of the invention to provide the second valve actuation unit, having a rocker arm which is provided between one of the intake valve and the exhaust valve and the common single camshaft and is rockably supported with the cylinder head and which rocks in accordance with rotation of the common single camshaft, is accommodated in the valve chamber in the front bank, and the first valve actuation unit is located in the valve chamber in the rear bank.

In a sixth aspect of the invention, the first valve actuation unit with two cam shafts having the double overhead camshaft structure is located in the valve chamber in one of the front bank and the rear bank, and the second valve actuation unit having the common single camshaft for both the intake valve and the exhaust valve is located in the valve chamber in the other one of the front bank and the rear bank.

Accordingly, in the sixth aspect hereof, in the bank where the second valve actuation unit is provided, the cylinder head and the cylinder head cover can be downsized or made smaller. In comparison with the case where the valve actuation units in the front bank and the rear bank both have the double overhead camshaft structure, even when the angle between the banks is widened, the longitudinal length from the front end of the front bank to the rear end of the rear bank is shortened by virtue of the downsized bank. As the vehicle components can be arranged in the space created by the downsizing, the arrangement according to the invention contributes to the reduction of the longitudinal length of the vehicle. Further, when the angle between the banks is narrowed, as the vehicle components can be arranged using space that is created above the downsized bank, the arrangement according to the invention contributes to downsizing of the vehicle in the vertical direction.

It is a seventh aspect of the invention to provide the cylinder head and the cylinder head cover associated with the front bank smaller and then the front wheel can be positioned closer to the rear wheel. This arrangement contributes to reduction of the length-direction of the vehicle.

According to an eighth aspect of the invention, as the cylinder head and the cylinder head cover in the rear bank can be downsized, space is created above the rear bank. The space accommodation for the air cleaner and the fuel tank above the engine can be ensured utilizing this area. Thus, increasing the size of the vehicle in the vertical direction can be suppressed. Further, as the height of the driver's seat behind or above the rear bank can be lowered, the footrest stability of the person on the rider's seat can be improved.

It is a ninth aspect of the invention to provide the valve rest mechanism in at least one of the intake-side and exhaust-side valve lifters, upsizing of the valve actuation unit due to the valve rest mechanism, by extension, upsizing of the cylinder head and the cylinder head cover, can be suppressed.

It is a tenth aspect of the invention to permit selective resting of cylinders in the rear bank while minimizing the size of the valve actuation unit due to the valve rest mechanism, so that a size of the cylinder head and the cylinder head cover, can also be minimized. The front bank, where the intake and exhaust valves are always operating, is exposed to running wind. Thus, the cooling of the front bank can be improved, and the cooling of the rear bank is unneeded when the rear bank is in cylinder rest time.

Modes for carrying out the present invention are explained below by reference to an embodiment of the present invention shown in the attached drawings. The above-mentioned object, other objects, characteristics and advantages of the present invention will become apparent from the detailed description of the embodiment of the invention presented below in conjunction with the attached drawings.

DETAILED DESCRIPTION OF ILLUSTRATIVE EMBODIMENTS

A number of working examples of the present invention will be described herein, based on selected illustrative embodiments of the present invention shown in the accompanying drawings.

Figure 1:
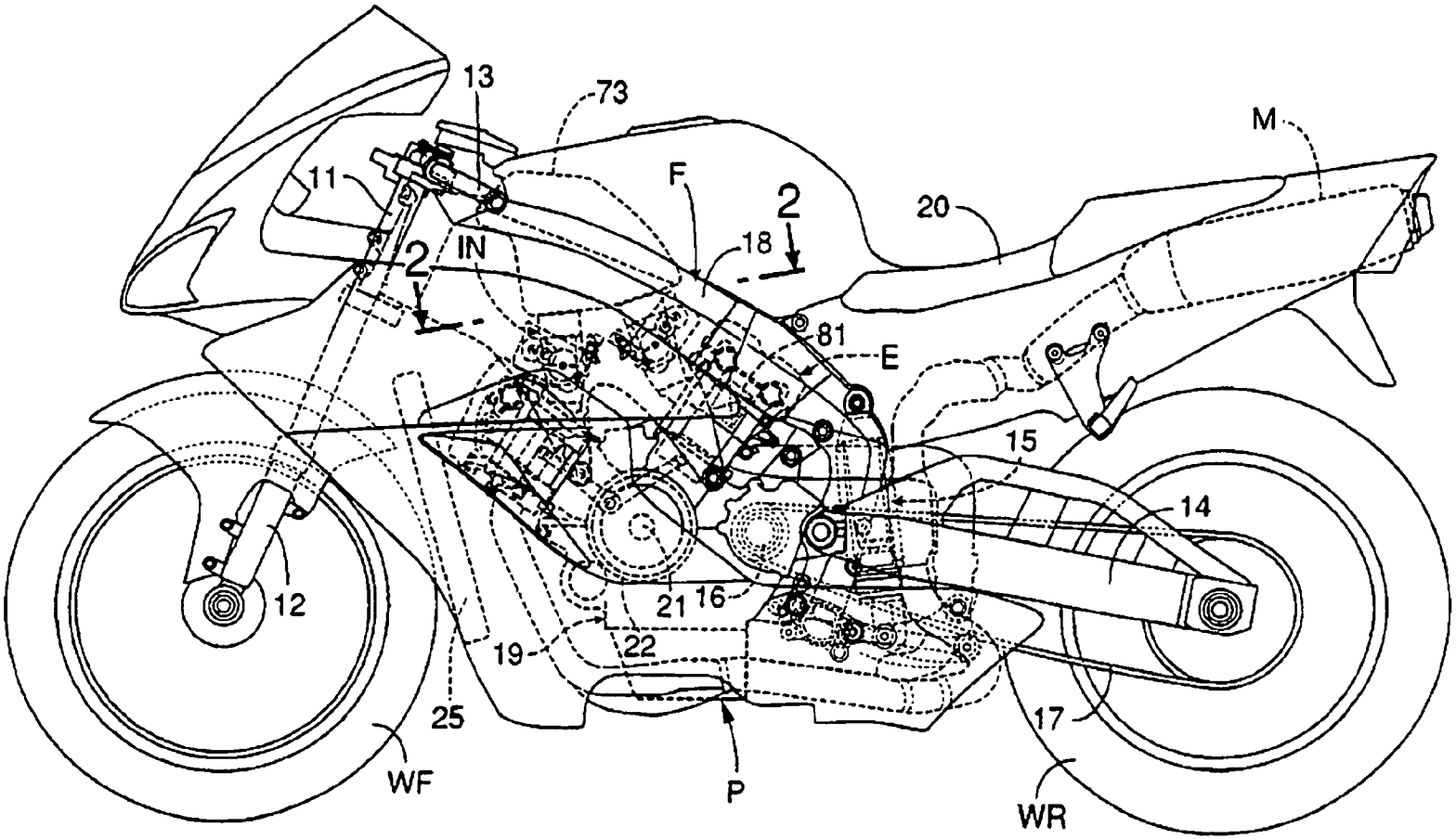
FIG. 1 is a side view of the motorcycle according to a first illustrative embodiment of the invention.

As seen in FIG. 1, a head pipe 11 is provided at a front end of a vehicle body frame F of a vehicle such as a motorcycle. A front fork 12 is provided to support a front wheel WF that is used for steering. A steering handlebar 13 is coupled to an upper part of the front fork 12. Further, in the vehicle body frame F, a rear fork 14 to support a rear wheel WR is vertically, rockably supported. The rear fork 14 is suspended on the vehicle frame F via a suspension member 15.

A power unit P including a four-cylinder, V-type engine E and a transmission (not shown) is mounted on the vehicle body frame F between the front wheel WF and the rear wheel WR. An output shaft 16 of the power unit P is interlocked and coupled with the rear wheel WR via a chain transmission mechanism 17.

Figure 2A:
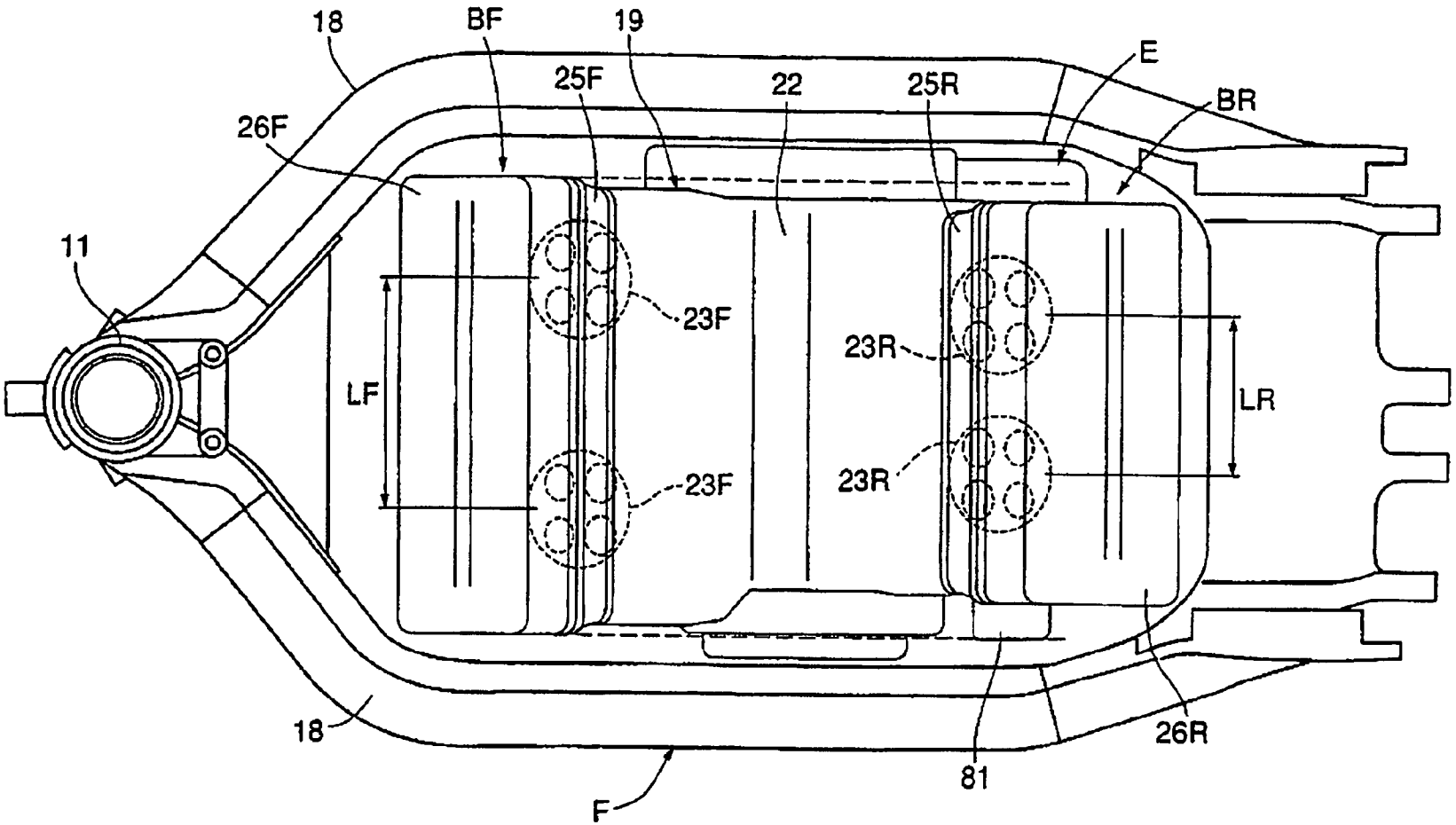
FIG. 2A is a top plan view of the vehicle body frame and the main engine body viewed from the line 2-2 in FIG. 1.

Now referring to FIG. 2A, it will be seen that the vehicle body frame F has a pair of main frames 18, 18 extending from either side of the head pipe 11 in a vehicle width direction, and extending rearwardly while also inclining downwardly. A main engine body 19 of the engine E is situated between the main frames 18. Further, a rider's seat 20, best seen in FIG. 1, is provided on the vehicle body frame F in a position behind and above the main engine body 19.

Figure 3:
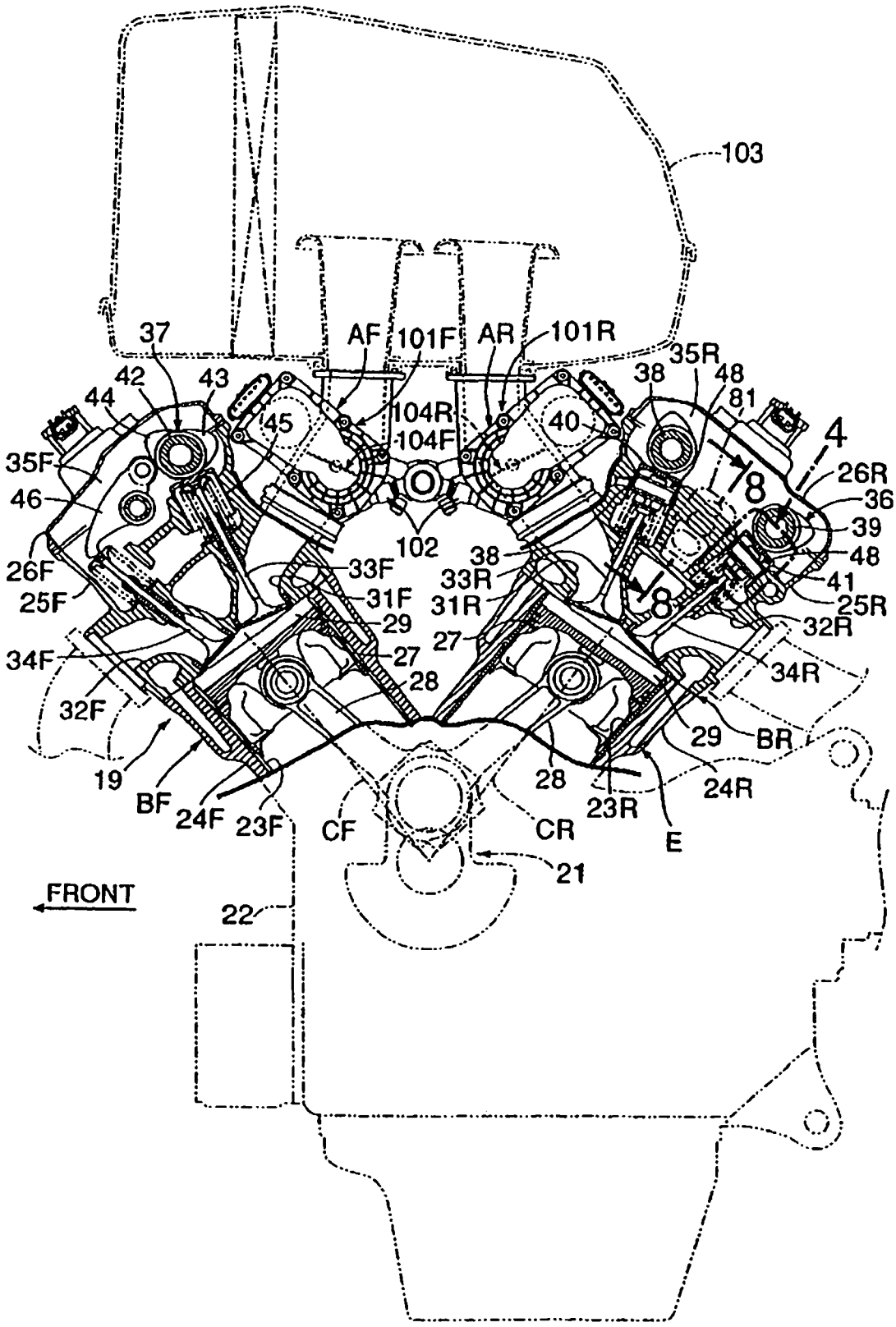
FIG. 3 is a longitudinal cross-sectional view of the main engine body.

With respect to FIG. 3, the main engine body 19 is arranged as a V-type engine including a front bank BF and a rear bank BR, separated in a longitudinal direction of the vehicle and cooperating to form a V shape. The front and rear banks BF, BR provide two cylinders arrayed in a horizontal direction of the vehicle body frame F. Lower parts of the front bank BF and the rear bank BR are both connected with a shared crankcase 22, rotatably supporting a crankshaft 21 having an axis line extending transverse to the longitudinal axis of the vehicle and in the vehicle width direction of the motorcycle.

Still referring to FIG. 3, the front bank BF includes a cylinder block 24F having a pair of cylinder bores 23F that have a cylinder axis line CF inclined upper-forward, a cylinder head 25F coupled to the cylinder block 24F, and a cylinder head cover 26F coupled to the cylinder head 25F. The rear bank BR has a cylinder block 24R having a pair of cylinder bores 23R having a cylinder axis line CR inclined upper-backward, a cylinder head 25R coupled to the cylinder block 24R, and a cylinder head cover 26R coupled to the cylinder head 25R. Further, individual pistons 27 are respectively slidably disposed in each of the respective cylinder bores 23F, 23R of the front and rear banks BF, BR, and are respectively connected with the commonly shared crankshaft 21 via connecting rods 28.

As best seen in FIG. 2A, in a first embodiment hereof, an interval or spacing LF between the respective central axes of the cylinder bores 23F in the front bank BF, is wider than an interval or spacing LR between the respective central axes of the cylinder bores 23R in the rear bank BR. Similarly, the width of the rear bank BR in a direction along the axis line of the crankshaft 22 is smaller than the width of the front bank BF, such that the rear bank is hidden behind the front bank BF in a front view.

Referring again to FIG. 3, combustion chambers 29 facing tops of the respective pistons 27 are respectively formed between the cylinder blocks 24F, 24R and the cylinder heads 25F and 25R in each cylinder of the front and rear banks BF and BR.

The cylinder head 25F in the front bank BF is provided with intake ports 31F and exhaust ports 32F communicable with the combustion chambers 29. The intake ports 31F are opened in a rear side surface of the cylinder head 25F to face a V-shaped space formed between the front bank BF and the rear bank BR. The exhaust ports 32F are opened in a front side surface of the cylinder head 25F. Further, the cylinder head 25R in the rear bank BR is provided with intake ports 31R and exhaust ports 32R communicable with the combustion chambers 29. The intake ports 31R are opened in a front side surface of the cylinder head 25 to face the V-shaped space. The exhaust ports 32R are opened in a rear side surface of the cylinder head 25R.

A rear valve chamber 35R is formed between the cylinder head 25R and the cylinder head cover 26R in the rear bank BR, for accommodating a first valve actuation unit 36 to selectively actuate the intake and exhaust valves 33R, 34R to open/close. Similarly, a front valve chamber 35F is formed between the cylinder head 25F and the cylinder head cover 26F in the front bank BF, for accommodating a second valve actuation unit 37 to selectively actuate the intake valves 33F and the exhaust valves 34F to open/close for each cylinder.

The first valve actuation unit 36 has intake-side and exhaust-side camshafts 38, 39 respectively provided above the intake valves 33R and the exhaust valves 34R. Individually corresponding to these valves 33R and 34R, closed-end cylindrical intake-side valve lifters 40 slidably engage with the cylinder head 25R between the intake-side camshaft 38 and the intake valves 33R so as to reciprocate in accordance with rotation of the intake-side camshaft 38, and closed-end cylindrical exhaust-side valve lifters 41 slidably engage with the cylinder head 25R between the exhaust-side camshaft 39 and the exhaust valves 34R so as to reciprocate in accordance with rotation of the exhaust-side camshaft 39, thus having a double overhead camshaft structure. Rotational motive power is transmitted in a one-half speed reduction ratio from the crankshaft 21 via a transmission unit (not shown) to the intake-side and the exhaust-side camshafts 38 and 39.

The second valve actuation unit 37 has a single camshaft 42 for the intake valves 33F and the exhaust valves 34F, closed-end cylindrical valve lifters 45 provided between intake-side valve cams 43 provided on the cam shaft 42 and intake valves 33F and slidably engaged with the cylinder head 25F, and rocker arms 46 are provided between exhaust-side valve cams 44 and the exhaust valves 34F so as to rock in accordance with the exhaust-side valve cam 44 provided on the camshaft 42. Rotational motive power is transmitted in a one-half speed reduction ratio from the crankshaft 21 via the transmission unit (not shown) to camshaft 42.

The second valve actuation unit 37 always actuates all the cylinders in the front bank BF during running of the engine E. On the other hand, the first valve actuation unit 36 holds at least one of the intake valves 33R and the exhaust valves 34R in a valve-close rest state and all the cylinders in the rear bank BR in a cylinder-rest state in correspondence with the running status of the engine EA. In the present embodiment, in the cylinder rest state, the first valve actuation unit 36 holds both the intake valves 33R and the exhaust valves 34R in the valve-close rest state, and a hydraulic valve rest mechanisms 48 to set the intake valves 33R and the exhaust valves 34R in the valve-close rest state are provided in the intake-side and the exhaust-side valve lifters 40, 41 of the first valve actuation unit 36.

Figure 4:
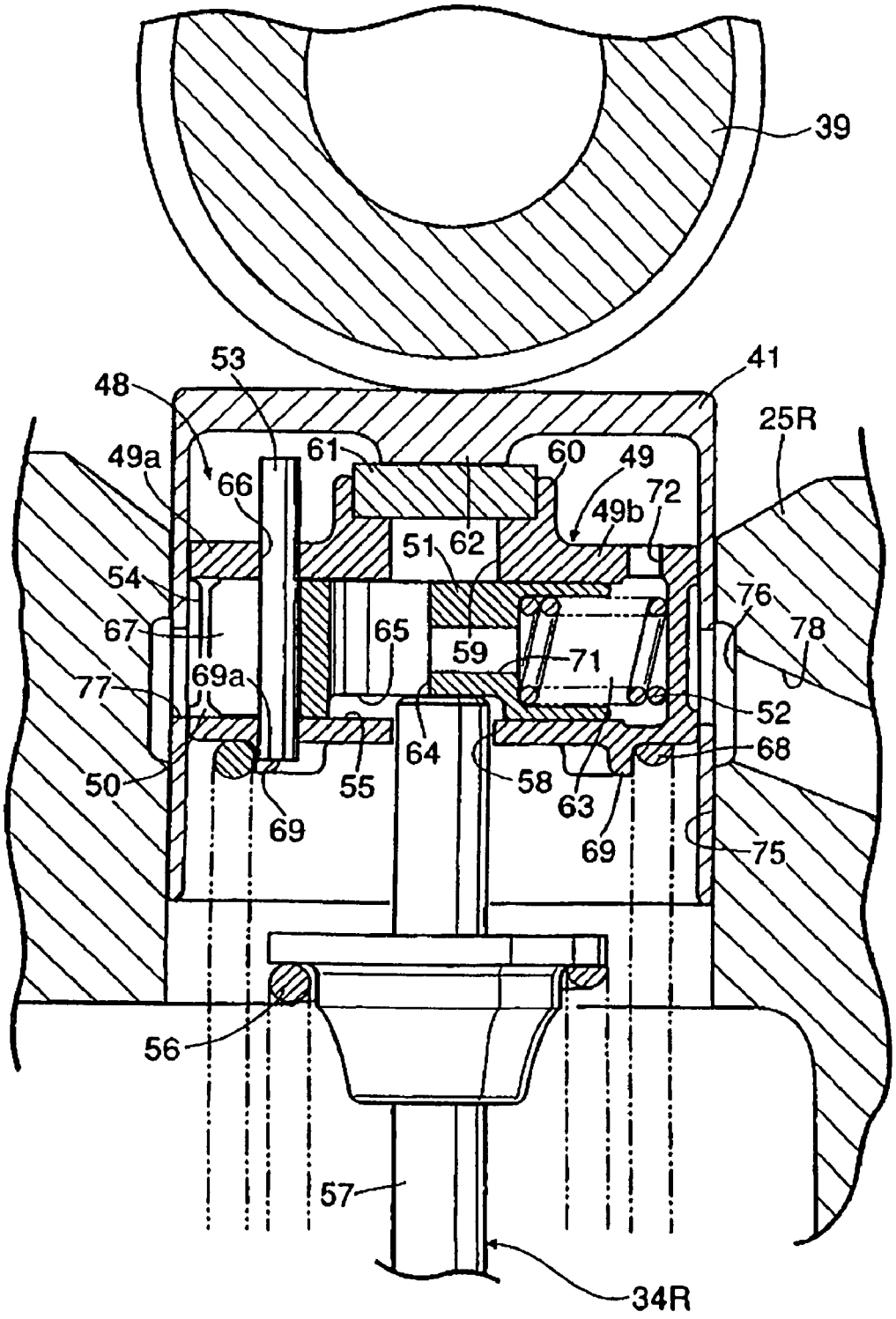
FIG. 4 is an enlarged view along the section outlined at 4 in FIG. 3.

In FIG. 4, the valve rest mechanism 48 provided in the exhaust-side valve lifter 41 has a pin holder 49 slidably engaged with the exhaust-side valve lifter 41, a slide pin 51, forming a hydraulic chamber 50 with respect to an inner surface of the exhaust-side valve lifter 41, slidably engaged with the pin holder 49, a return spring 52, provided between the slide pin 51 and the pin holder 49, to exert a spring force to push the slide pin 51 in a direction to reduce the volume of the hydraulic chamber 50, and a stopper pin 53, provided between the slide pin 51 and the pin holder 49, to regulate a moving end of the slide pin 51 to the side to reduce the volume of the hydraulic chamber 50 while preventing rotation of the slide pin 51 about its axis line.

Figure 5:
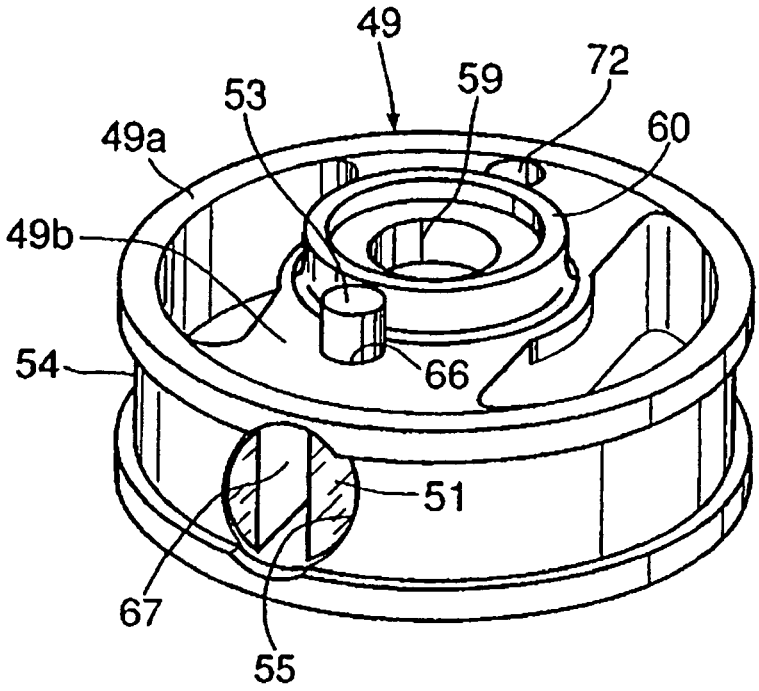
FIG. 5 is a perspective view of the pin holder viewed from an upper direction.
Figure 6:
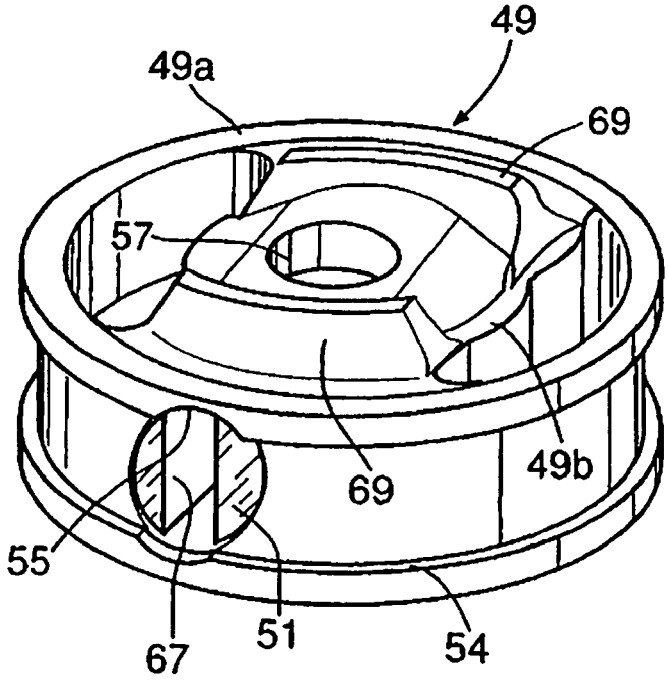
FIG. 6 is a perspective view of the pin holder viewed from a lower direction.

Referring to FIGS. 5 and 6, the pin holder 49 has a ring member 49*a* integrally formed, the pin holder 49 slidably engaged in the exhaust-side valve lifter 41, and has a suspension member 49*b*, along one diametric line of the ring member 49*a*, that connects inner peripheral portions of the ring 49*a*. The inner periphery of the ring member 49*a* and portions between both side surfaces of the suspension member 49*b* are made thinner for the purpose of saving weight.

The pin holder 49 has a ring groove 54 provided in an outer periphery of the outer periphery of the ring member 49*a*. A slide hole 55 with an enclosed end has an axial line orthogonal to an axis line along the one diametric line of the ring member 49, the axis line of the exhaust-side valve lifter 41. The slide hole 55 with its one end opened in the ring groove 54 and its other end closed, is provided in the suspension member 49*b* in the pin holder 49. Further, an end of a valve stem 57 of the exhaust valve 34R is urged in a valve-closing direction by a valve spring 56 is provided such that its inner end is positioned in the insertion hole 58 and slide hole 55, in a central lower portion of the suspension member 49*b*. An extended hole 59, in which the end of the valve stem 57 can be located, with the slide hole 55 between the insertion hole 58 and the extended hole 59, is coaxially positioned with respect to the insertion hole 58.

Further, a cylindrically shaped accommodation cylinder 60, integral with suspension member 49*b* is coaxial with an axis line of the extended hole 59 in the pin holder 49. A part of a disk-shaped shim 61 used to close an end of the extended hole 59 on the closing end side of the exhaust-side valve lifter 41 is engaged with the accommodation cylinder 60. Further, a projection 62 is provided to contact the shim 61 and is integrally provided in a central portion of an inner surface of the closing end of the exhaust-side valve lifter 41.

The slide pin 51 is slidably engaged with the slide hole 55 of the pin holder 49. The hydraulic chamber 50 is formed between one end of the slide pin 51 and the inner surface of the exhaust-side valve lifter 41 and communicates with the ring groove 54. The return spring 52 is located in a spring chamber 63 formed between the other end of the slide pin 51 and a closing end of the slide hole 55.

Figure 7:
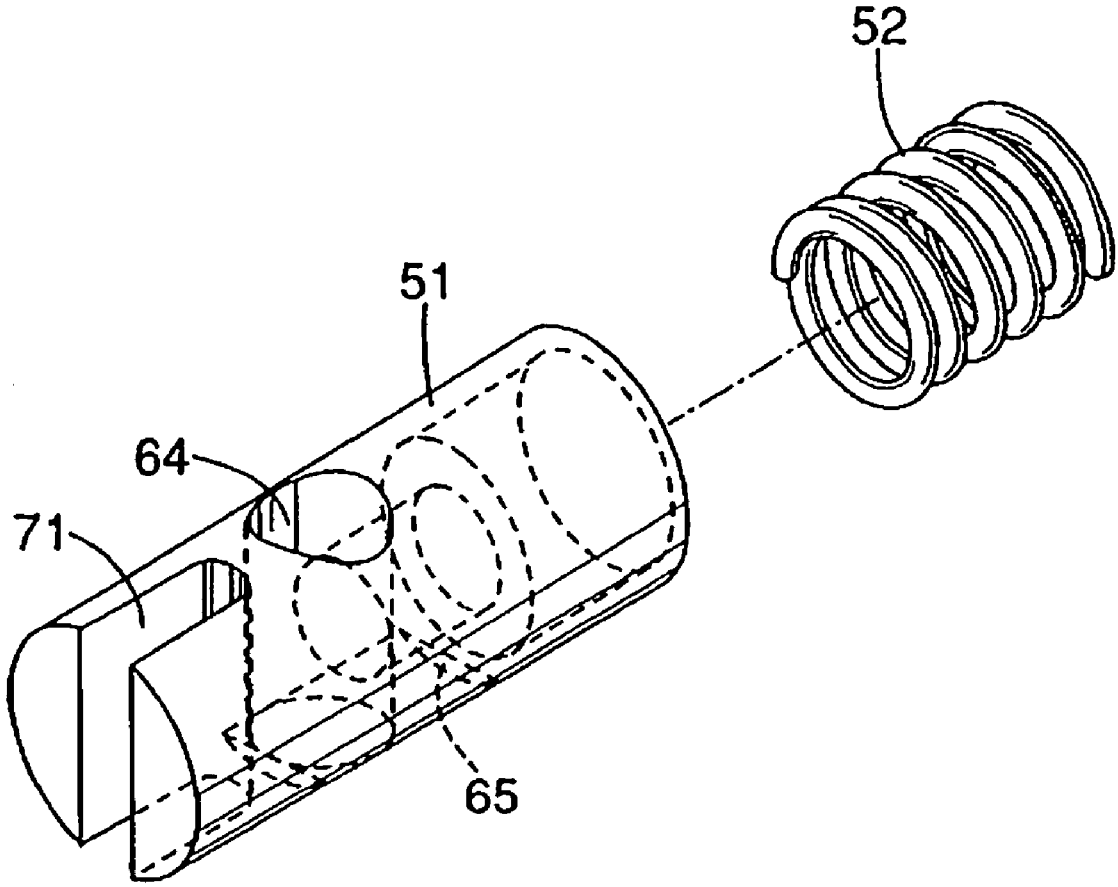
FIG. 7 is a perspective view of the slide pin and the return spring.

Now referring to FIG. 7, an accommodation hole 64 coaxially communicable with the insertion hole 58 and the extended hole 59, in which the end of the valve stem 57 can be located, is provided in a central portion in an axial direction of the slide pin 51. The end of the accommodation hole 64 on the side of the insertion hole 58 is opened in a flat contact surface 65 formed on a lower outer side surface of the slide pin 51 opposite to the insertion hole 58. The contact surface 65 is comparatively long along the axis line direction of the slide pin 51. The accommodation hole 64 is opened in a portion of the contact surface 59 closer to the hydraulic chamber 50.

Slide pin 51 is movable in the axial direction by a hydraulic pressure force which acts on one end side of the slide pin 51. Pin 51 is positioned when hydraulic pressure of the hydraulic chamber 50 is balanced by a spring force which acts on the other end of the slide pin 51 by the return spring 52. In non-operating time, where the hydraulic pressure of the hydraulic chamber 50 is low, as shown in FIG. 4, the accommodation hole 64 is shifted from the axis line of the insertion hole 58 and the extended hole 59 and the end of the valve stem 57 is in contact with the contact surface 65. In an operating time, where the hydraulic pressure of the hydraulic chamber 50 is high, the end of the valve stem 57 is positioned in the insertion hole 58 which has been moved to the right side in FIG. 4 so the valve stem 57 is located in the accommodation hole 64 and the extended hole 59.

When the slide pin 51 moves to a position where the accommodation hole 64 is coaxially communicated with the insertion hole 58 and the extended hole 59, the pin holder 49 and the slide pin 51 are also moved lower towards the exhaust valve 34R together with the exhaust valve lifter 41 in accordance with downward movement of the exhaust-side valve lifter 41 by a pressure force which acts from the exhaust-side camshaft 39. However, at this time only the end of the valve stem 57 is located in the accommodation hole 64 and the extended hole 59 preventing the pressure force in a valve-opening direction from acting on the exhaust valve 34R from the exhaust valve lifter 41 and the pin holder 49, and the exhaust valve 34R remains closed, i.e., in the suspended state. Further, when the slide pin 51 moves to a position where the end of the valve stem 57 is in contact with the contact surface 65, the pressure force in the valve-opening direction from cam 39 acts on the exhaust valve 34R in accordance with movement of the pin holder 49 and the slide pin 51 downwards towards the exhaust valve 34R corresponding to the movement of the exhaust-side valve lifter 41 by pressure force from the exhaust-side camshaft 39, the exhaust valve 34R is opened/closed in correspondence with rotation of the exhaust-side camshaft 39.

When the slide pin 51 rotates about its axis line in the pin holder 49, the axis line of the accommodation hole 64 is shifted from that of the insertion hole 58 and the extended hole 59. Since the end of the valve stem 57 cannot be brought into contact with the contact surface 65 if this occurs, the rotation of the slide pin 51 about the axis line is prevented with the stopper pin 53.

The stopper pin 53 has an axis line parallel to the axis line of the exhaust-side valve lifter 41 along the one diametric line of the slide hole 55 and is positioned in an attachment hole 66 coaxially provided in the suspension member 49*b* in the pin holder 49. The stopper pin 53 is inserted through a slit 67 provided on one side of the slide pin 51 such that pin 51 is opened on the side of the hydraulic chamber 50. That is, the stopper pin 53 is attached to the pin holder 49 through the slide pin 51 while allowing movement of the slide pin 51 along its axis line. Since the stopper pin 53 is in contact with an inner end closed portion of the slit 67, the movement of the slide pin 51 to the side of the hydraulic chamber 50 is limited A coil spring 68 is provided to urge the pin holder 49 upward toward cam 39 so that shim 61 that is attached to the pin holder 49 is brought into contact with the projection 62 provided in the central portion of the inner surface of the closed end of the exhaust-side valve lifter 41. Spring 68 is provided between the pin holder 49 and the cylinder head 25R so as to surround the valve stem 57 so that contact between the outer periphery of the coil spring 68 and the inner surface of the exhaust-side valve lifter 41 is avoided. A pair of projections 69, 69 for positioning the end of the coil spring 68 in a direction orthogonal to the axis line of the valve stem 57 is integrally formed on the suspension member 49*b* in the pin holder 49. Further, both projections 69 are integrally formed with the pin holder 49 with the projection amount being equal to or less than the wire diameter of the coil spring 68. The projections are formed in arcuate shape with the axis line of the valve stem 57 as their center. Further, a step member 69*a*, in contact with the end of the stopper pin 53 on the side of the exhaust valve 34R to prevent movement of the stopper pin 53 lower towards the exhaust valve 34R, is formed in one of the projections 69.

The slide pin 51 is provided with a first communicating hole 71 to communicate the spring chamber 63 with the accommodation hole 64 so as to prevent a change of pressure in the spring chamber 63 affecting the movement of the slide pin 51 in the axial direction. The pin holder 49 is provided with a second communicating hole 72 to communicate space between the pin holder 49 and the exhaust-side valve lifter 41 with the spring chamber 63 so as to prevent change of pressure in the space by temperature change.

The cylinder head 25R is provided with a support hole 75 that engages the exhaust-side valve lifter 41 so that the exhaust-side valve lifter 41 slidably fits within hole 75. The support hole 75 is provided with a ring concave member 76 surrounding the exhaust-side valve lifter 41 in its inner surface. Further, the exhaust-side valve lifter 41 is provided with a third communicating hole 77 to communicate the ring concave member 76 with the ring groove 54 of the pin holder 49 regardless of sliding of the valve lifter 41 in the support hole 75. Further, the cylinder head 25R is provided with an oil passage 78 communicating with the ring concave member 76.

The valve rest mechanism 48 is also provided in the intake-side valve lifter 40 as in the case in the exhaust-side valve lifter 41.

Figure 2B:
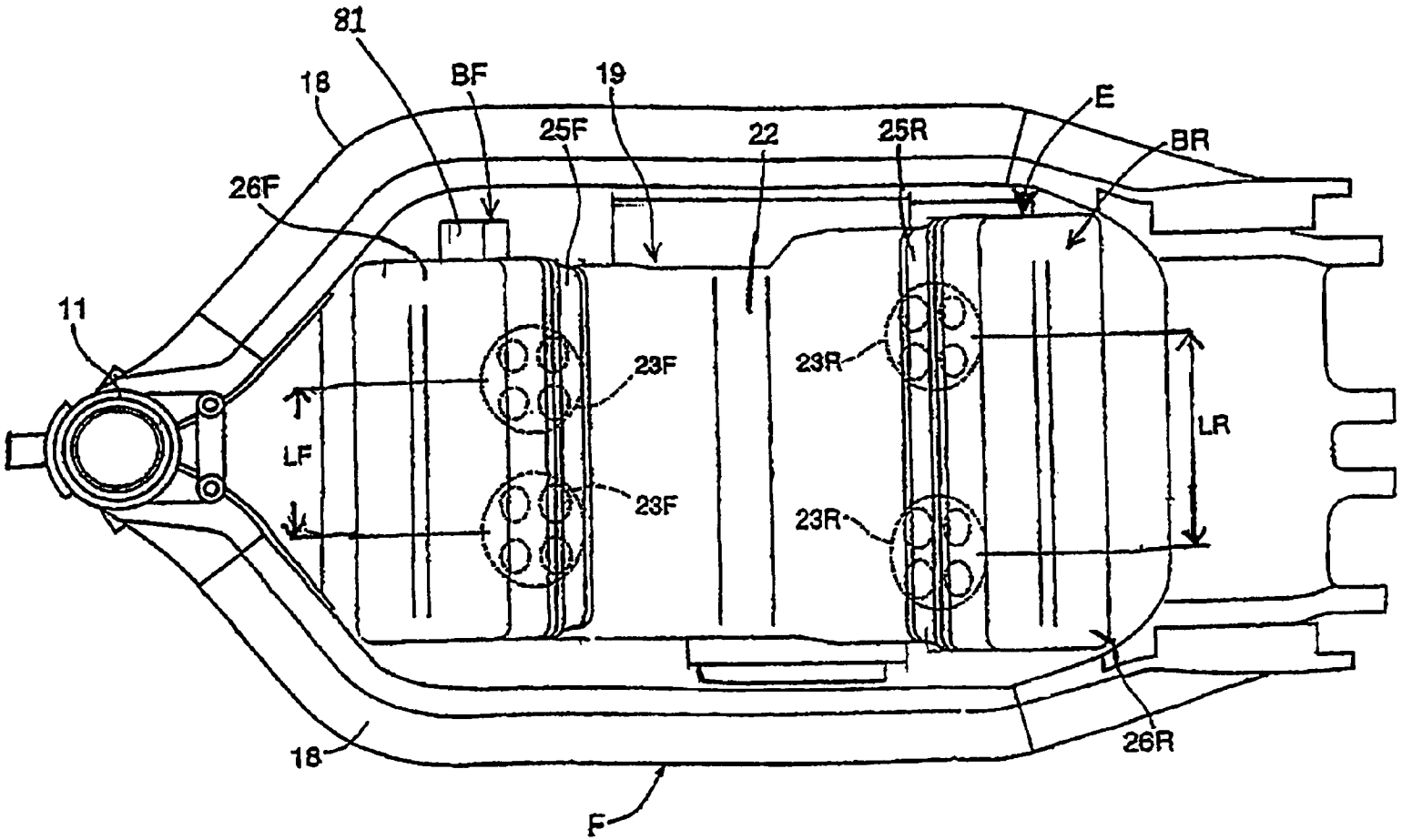
FIG. 2B shows the main engine body with a second, alternate arrangement of the banks of the engine.

The hydraulic pressure in the hydraulic chambers 50 in the hydraulic type valve rest mechanisms 48 provided in the first valve actuation unit 36 on the side of the rear bank BR is controlled by the hydraulic controller 81 provided in the cylinder head 25R in the rear bank BR. The hydraulic controller 81 is provided on at least one of both end side surfaces of the cylinder head 25R along the axis line of the crankshaft 21. In this embodiment, as shown in FIG. 2, the hydraulic controller is provided on a left side surface of the cylinder head 25R in the rear bank BR in a position inside from the left side main frame 18 of the both main frames 18.

Figure 8:
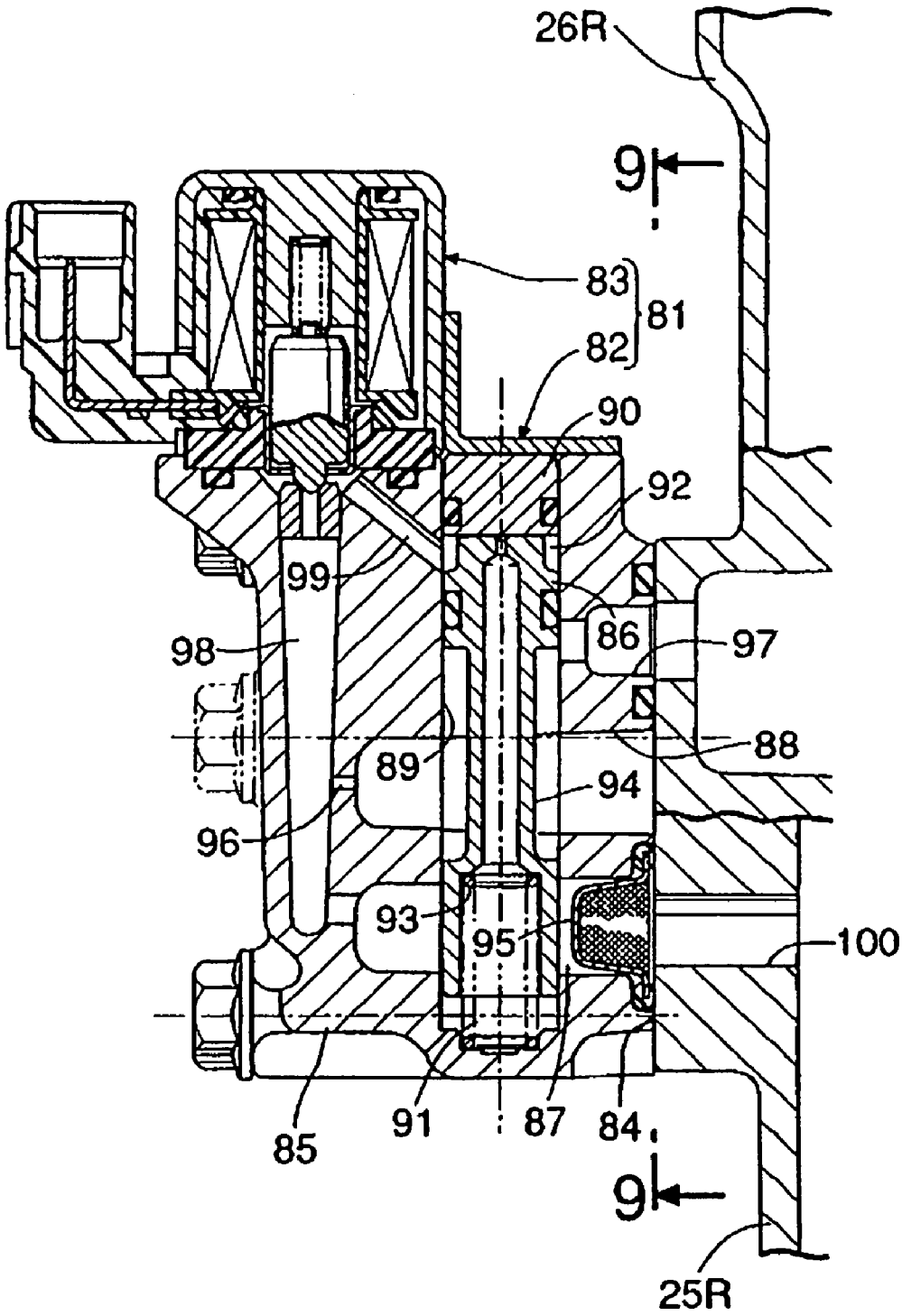
FIG. 8 is a longitudinal cross-sectional view of the hydraulic controller along the line 8-8 in FIG. 3.
Figure 9:
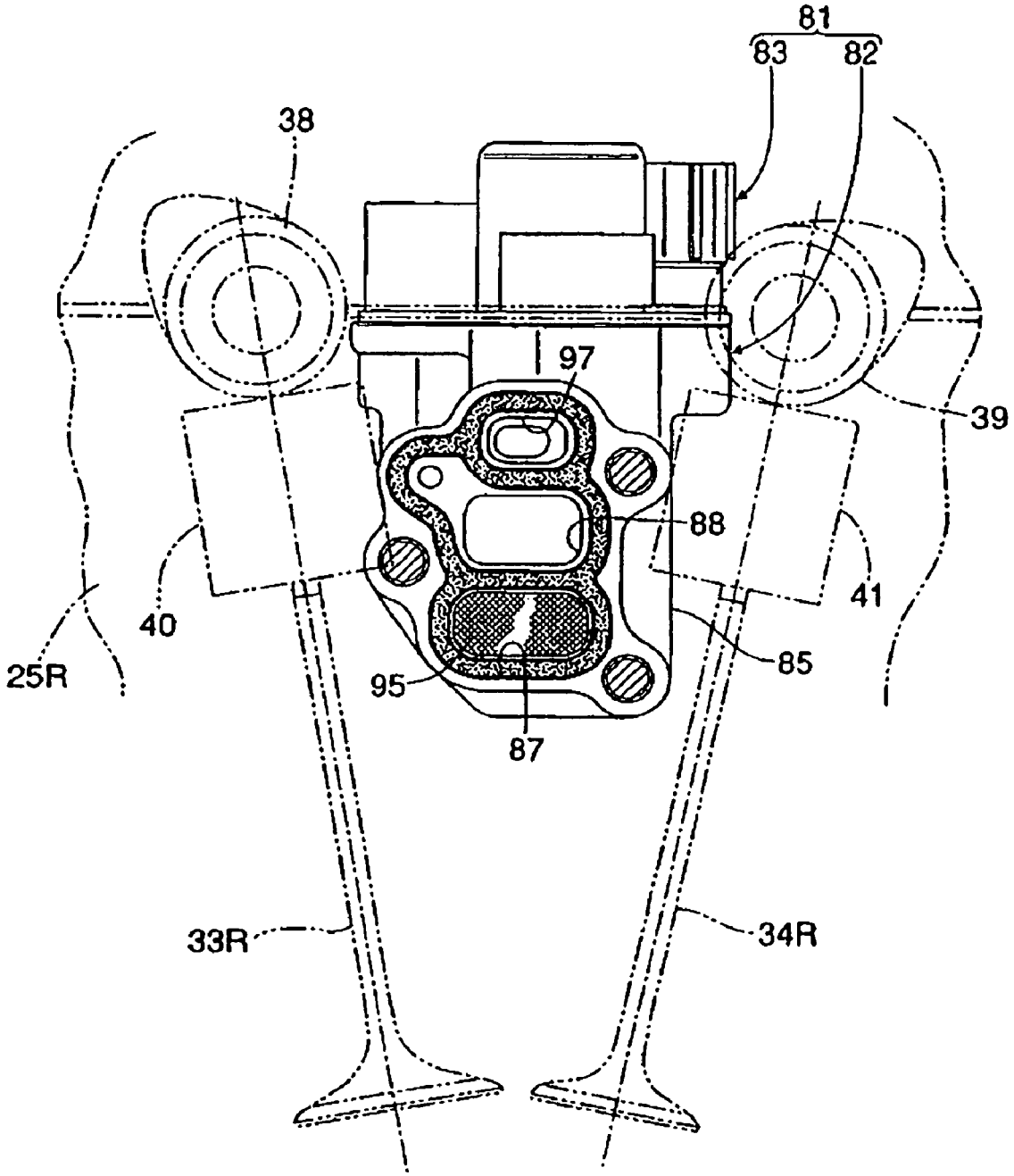
FIG. 9 is a view taken along the line 9-9 in FIG. 8.

In FIGS. 8 and 9, the cylinder head 25R is provided with a flat attachment surface 84 on its left sidewall. The hydraulic controllers 81 have a spool valve 82 attached to the attachment surface 84 and an electromagnetic opening/closing valve 83 attached to the spool valve 82.

The spool valve 82 has a valve housing 85, having an inlet port 87 and an outlet port 88 joined to the attachment surface 84, and a spool valve body 86 slidably engaged with the valve housing 85.

The valve housing 85 is provided with slide hole 89 having one end closed and the other end opened, and a cap 90 to close the other end opening of the slide hole 89 engaged with the valve housing 85. Further, the spool valve body 86 is slidably engaged with the slide hole 89. A spring chamber 91 is formed between the spool valve body 86 and the one end closed portion of the slide hole 89, and a pilot chamber 92 is formed between the other end of the spool valve body 86 and the cap 90. A spring 93, which pushes the spool valve body 86 towards chamber 92 to reduce the volume of the pilot chamber 92, is located in the spring chamber 91.

The inlet port 87 and the outlet port 88 are provided in the valve housing 85 so as to be opened in the inner surface of the slide hole 89 in positions sequentially away from one end to the other end of the slide hole 89 along its axis line. The spool valve body 86 is provided with a ring concave member 94 communicable between the inlet port 87 and the outlet port 88. As shown in FIG. 8, when the spool valve body 86 is moved to a position to reduce the volume of the pilot chamber 92 to a minimum value, the spool valve body 86 functions as a block between the inlet port 87 and the outlet port 88.

An oil filter 95 is attached to the inlet port 87, and an orifice 96 communicating the inlet port 87 with the outlet port 88 is provided in the valve housing 85. Accordingly, even when the spool valve body 86 is in the position to function as a block between the inlet port 87 and the outlet port 88 as shown in FIG. 8, the inlet port 87 and the outlet port 88 communicate with each other via the orifice 96, and hydraulic oil supplied to the inlet port 87 is slowed by the orifice 96 and flows to the side of the outlet port 88.

Further, the valve housing 85 is provided with a release port 97 which communicates with the outlet port 88 via the ring concave member 94 only when the spool valve body 86 is in a position to function as a block between the inlet port 87 and the outlet port 88. The release port 97 relieves the pressure in the space between the cylinder head 25R and the cylinder head cover 26R.

Further, the valve housing 85 is provided with a passage 98 always communicating with the inlet port 87. The passage 98 is connected via an electromagnetic opening/closing valve 83 to a connection hole 99 which communicates with the pilot chamber 92 and is provided in the valve housing 85. Accordingly, when the electromagnetic opening/closing valve 83 is opened, hydraulic pressure is supplied to the pilot chamber 92, and the spool valve body 86 is urged downward to increase the volume of the pilot chamber 92. Then the inlet port 87 and the outlet port 88 communicate with each other via the ring concave member 94 of the spool valve body 86 while the outlet port 88 is blocked from the release port 97.

An oil pump (not shown) to operate in accordance with the crankshaft 21 is located in the crankcase 22. Hydraulic oil supplied from the oil pump is supplied via an oil passage 100 provided in the cylinder head 25R to the inlet port 87 in the hydraulic controller 81.

Best seen in FIG. 4, the oil passage 78 with its one end communicating with the ring concave members 76 in the valve rest mechanisms 48 is provided in the cylinder head 25R, with its other end communicating with the outlet port 88 of the hydraulic controller 81.

Referring now to FIGS. 4 and 8, when the electromagnetic opening/closing valve 83 of the hydraulic controller 81 opens, the inlet port 87 and the outlet port 88 communicate with each other, and the high hydraulic pressure acts on the hydraulic chambers 50 of the valve rest mechanisms 48. When the valve rest mechanisms 48 operate to cause the intake valves 33R and the exhaust valves 34R into a valve-closed rest state and the electromagnetic opening/closing valve 83 of the hydraulic controller 81 is closed, the communication between the inlet port 87 and the outlet port 88 is broken. When the outlet port 88 communicates with the release port 97, the hydraulic pressure in the hydraulic chamber 50 is released. The slide pins 51 of the valve rest mechanisms 48 are moved to the position to actuate the intake valves 33R and the exhaust valves 34R.

Returning to FIGS. 2 and 3, in the cylinder head 25F in the front bank BF, throttle bodies 101F are respectively connected with the respective intake ports 31F. In the cylinder head 25R in the rear bank BR, throttle bodies 101R are respectively connected with the intake ports 31R. Fuel injection valves 102, 102 to inject fuel toward the respective intake ports 31F, 31R are respectively attached to the respective throttle bodies 101F, 101R. Further, the throttle bodies 101F on the side of the front bank BF and the throttle body 101R on the side of the rear bank BR are connected in common to an air cleaner 103 provided above these throttle bodies 101F, 101R.

Throttle valves 104F of two throttle bodies' 101F on the side of the front bank BF are rotation-controlled. A single electric actuator AF for both throttle bodies' 101F is provided in one of the throttle body 101F of the both throttle bodies' 101F. On the other hand, throttle valves 104R of both throttle bodies 101R on the side of the rear bank BR are individually rotation-controlled. Electric actuators AR, AR to control intake amounts for the respective cylinders are individually provided in both throttle bodies 101R.

Next, an operation of the first embodiment will be described. The first valve actuation unit 36 having a double overhead camshaft structure, in which the intake-side and exhaust-side camshafts 38, 39 individually correspond to the intake valves 33R and the exhaust valves 34R, is located in the valve chamber 35R in the rear bank BR of the V-shaped main engine body 19. The second valve actuation unit 37 has a common single camshaft 42 for the intake valves 33F and the exhaust valves 34F located in the valve chamber 35F in the front bank BF.

Accordingly, in the front bank BF on the side where the second valve actuation unit 37 is provided, the cylinder head 25F and the cylinder head cover 26F can be downsized or made smaller. In comparison with the case where the valve actuation units in the front bank BF and the rear bank BR both have the double overhead camshaft structure, even when the angle between both banks BF, BR is widened, the longitudinal length from the front end of the front bank BF to the rear end of the rear bank BR can be shortened. This contributes to reduction of the longitudinal length of the vehicle. Further, when the angle between both banks BF, BR is narrowed, downsizing of the vehicle in the vertical direction is achieved. As the cylinder head 25F and the cylinder head cover 26F in the front bank BF can be downsized, the radiator 25 and the front wheel WF in front of the main engine body 19 can be provided closer to the side of the rear wheel WR. This contributes to reduction in size of the length of the vehicle.

Further, the first valve actuation unit 36 has the intake-side valve lifters 40 slidably engaged with the cylinder head 25R between the intake valves 33R and the intake-side camshafts 38 so as to reciprocate in accordance with rotation of the intake-side camshaft 38, and the exhaust-side valve lifters 41 slidably engaged with the cylinder head 25R between the exhaust valves 34R and the exhaust-side camshaft 39 so as to reciprocate in accordance with rotation of the exhaust-side camshaft 39. As the valve rest mechanisms 48 are provided in the intake-side valve lifters 40 and the exhaust-side valve lifters 41, increasing the size of the first valve actuation unit 36 due to the valve rest mechanisms 48, and, by extension, increasing the size of the cylinder head 25R and the cylinder head cover 26R, is not necessary.

Further, as the cylinders in the rear bank BR can be set into the cylinder rest state, the front bank BF where the intake valves 33F and the exhaust valves 34F are always operating is exposed to running wind, thus the cooling of the front bank BF can be improved. The cooling of the rear bank BR is not as needed since the cylinder rest time allows the rear bank BR to operate at a cooler temperature.

Further, the hydraulic controller 81 that controls the hydraulic pressure of the valve rest mechanisms 48 is provided in the cylinder head 25R in the rear bank BR. The hydraulic controller 81 is located near the valve rest mechanisms 48 allowing the oil passage 78 from the hydraulic controller 81 to the valve rest mechanisms 48 to be reduced in length and the structure of the oil passage can be simplified. Further, as the hydraulic controller 81 is provided on at least one of the side surfaces of the cylinder head 25R along the axis line of the crankshaft 21 on the left side surface of the cylinder head 25R in the first embodiment, the hydraulic controller 81 does not influence the arrangement of the intake pipes and the exhaust pipes connected with the cylinder head 25R.

Further, the rear bank BR is smaller than the front bank BF in width in the vehicle width direction so as to be hidden behind the front bank BF. The hydraulic controller 81 is provided on the left side surface of the cylinder head 25R in the rear bank BR. Accordingly, hydraulic controller 81 does not project from the width of the engine E, and protection of the hydraulic controller 81 can be facilitated. Further, the rider's seat 20 is provided in a position close to the rear bank BR behind the bank. Since the hydraulic controller 81 is provided on the side surface of the cylinder head 25R any influence on the vehicle rider is avoided by the reduction of the width of the rear bank BR compared to the width of the front bank BF.

Further, the vehicle body frame F on which the main engine body 19 is mounted has the head pipe 11 steerably supporting the front fork 12 and the pair of left and right main frames 18 expanded in the vehicle width direction from the head pipe 11 and extended backward. The main engine body 19 is mounted on the vehicle body frame F such that the hydraulic controller 81 is provided inside the left side main frame 18, the hydraulic controller 81 can be protected by the outside main frame 18. Since a specialized member for protection of the hydraulic controller 81 is unnecessary, the number of parts can be reduced.

As a second embodiment of the present invention, it may be arranged such that in the main engine body 19, the first valve actuation unit 36 is located in the valve chamber 35F in the front bank BF and the second valve actuation unit 37 is located in the valve chamber 35R in the rear bank BR.

According to the second embodiment, as the cylinder head 25R and the cylinder head cover 26R in the rear bank BR can be downsized, space occurs above the rear bank BR. The space available for the air cleaner 73 and the fuel tank above the engine E can be ensured utilizing this space, and enlarging the vehicle in the vertical direction is not necessary. Further, since the height of the rider's seat 20 behind or above the rear bank BR can be lowered, the footrest stability of the person on the rider's seat 20 can be improved.

The embodiments of the present invention have been described as above. The present invention is not limited to the above embodiments, but various design changes can be made without departing from the present invention in the Claims.

What is claimed is:

1. A V-type engine for a vehicle, in which in an engine main body comprises a front bank and a rear bank which cooperate to form a V shape extending in a longitudinal direction of the vehicle, which cooperate to form a V shape extending in a longitudinal direction of the vehicle, each of said banks comprising a cylinder head and a cylinder head cover operatively attached to the cylinder head and cooperating therewith to define a valve chamber therebetween, said engine further comprising a pair of valve actuation units for selectively actuating intake valves and exhaust valves, said valve actuation units comprising:

a first valve actuation unit located in the valve chamber of one of the front bank and the rear bank, said first valve actuation unit having a double overhead camshaft structure comprising intake-side and exhaust-side camshafts individually corresponding to the intake valve and the exhaust valve; and a second valve actuation unit located in the valve chamber of the other of the front bank and the rear bank, said second valve actuation unit having a common single camshaft for the intake valve and the exhaust valve.

2. The V-type engine for a vehicle according to claim 1, wherein the first valve actuation unit is located in the valve chamber of the rear bank, and the second valve actuation unit is located in the valve chamber of the front bank.

3. The V-type engine for a vehicle according to claim 1, wherein the first valve actuation unit is located in the valve chamber of the front bank, and the second valve actuation unit is located in the valve chamber of the rear bank.

4. The V-type engine for a vehicle according to claim 1, wherein the first valve actuation unit has an intake-side valve lifter slidably engaged with a cylinder head between the intake valve and the intake-side camshaft so as to reciprocate the intake valve in accordance with rotation of the intake-side camshaft, and an exhaust-side valve lifter slidably engaged with the cylinder head between the exhaust valve and the exhaust-side camshaft so as to reciprocate the exhaust valve in accordance with rotation of the exhaust-side camshaft; and wherein the engine further comprises a valve rest mechanism situated in at least one of said valve lifters, said valve rest mechanism being selectively operable to temporarily hold at least one of the intake valve and the exhaust valve in a valve-close rest state in correspondence with a running status of the vehicle.

5. The V-type engine for a vehicle according to claim 4, wherein the first valve actuation unit is located in the valve chamber of the rear bank, and the second valve actuation unit comprises a rocker arm and is located in the valve chamber of the front bank, wherein said rocker arm is provided between the single camshaft and one of the intake valve and the exhaust valve, is rockably supported with respect to the cylinder head, and is rockably movable in accordance with rotation of the common single camshaft.

6. The V-type engine for a vehicle according to claim 1, wherein the front bank is wider than the rear bank.

7. The V-type engine for a vehicle according to claim 1, wherein the first valve actuation unit comprises a hydraulically controlled valve rest mechanism operatively associated with each valve thereof.

8. The V-type engine for a vehicle according to claim 7, wherein the valve rest mechanism is operable to temporarily idle the valves when hydraulic pressure is applied thereto.

9. The V-type engine for a vehicle according to claim 8, wherein the hydraulic pressure is controlled by an electromagnetic controller.

10. The V-type engine for a vehicle according to claim 9, wherein the electromagnetic controller is located on the engine where it is protected by a portion of the vehicle frame.

11. A vehicle comprising a frame and an engine mounted to the frame, in which in an engine main body comprises a front bank and a rear bank which cooperate to form a V shape extending in a longitudinal direction of the vehicle, each of said banks comprising a cylinder head and a cylinder head cover operatively attached to the cylinder head and cooperating therewith to define a valve chamber therebetween, said engine further comprising a pair of valve actuation units for selectively actuating intake valves and exhaust valves, said valve actuation units comprising:

a first valve actuation unit located in the valve chamber of one of the front bank and the rear bank, said first valve actuation unit having a double overhead camshaft structure comprising intake-side and exhaust-side camshafts individually corresponding to the intake valve and the exhaust valve; and a second valve actuation unit located in the valve chamber of the other of the front bank and the rear bank, said second valve actuation unit having a common single camshaft for the intake valve and the exhaust valve; and a valve rest mechanism for selectively idling certain ones of the valves, depending on a running status of the engine.

12. The vehicle of claim 11, wherein each bank comprises two cylinders arrayed in a longitudinal direction of the vehicle, and wherein the front bank is wider than the rear bank.

13. The vehicle of claim 11, wherein a valve rest mechanism is provided for each of the valves, and is operable to selectively idle its associated valve in a closed position, depending on running status of the engine.

14. The vehicle of claim 13, wherein the engine comprises at least one hydraulic controller which is operably connected to the valve rest mechanisms.

15. The vehicle of claim 14, wherein each of the valve rest mechanisms is capable of selectively slidably receiving an associated valve stem through a portion thereof.

16. The vehicle of claim 15, wherein the valve rest mechanism allows its associated valve to operate normally when hydraulic pressure supplied thereto is low, and keeps the valve in a closed position when hydraulic pressure is raised.

17. The vehicle of claim 16, wherein the hydraulic controller electromagnetically controls a valve that increases or decreases the hydraulic pressure depending on the engine running status.

18. The valve of claim 17, wherein the hydraulic controller includes a spool valve that is movable between a high hydraulic pressure position and a low hydraulic pressure position.

19. The vehicle of claim 18, wherein each of the valve rest mechanisms includes a slide pin which is operable to move axially under hydraulic pressure.

20. A motorcycle of the type having a front wheel for steering, a rear wheel, a frame, a power source for transmitting power to the rear wheel, the power source comprising an engine and a transmission, the engine comprising an engine main body comprising a front bank and a rear bank which cooperate to form a V shape extending in a longitudinal direction of the motorcycle, each of said banks comprising a cylinder head and a cylinder head cover operatively attached to the cylinder head and cooperating therewith to define a valve chamber therebetween, said engine further comprising a pair of valve actuation units for selectively actuating intake valves and exhaust valves, said valve actuation units comprising:

a first valve actuation unit located in the valve chamber of one of the front bank and the rear bank, said first valve actuation unit having a double overhead camshaft structure comprising intake-side and exhaust-side camshafts individually corresponding to the intake valve and the exhaust valve; and a second valve actuation unit located in the valve chamber of the other of the front bank and the rear bank, said second valve actuation unit having a common single camshaft for the intake valve and the exhaust valve;

a valve rest mechanism for selectively holding some of the valve in a valve rest state depending on a running status of the engine, the valve rest mechanism provided in at least one of the valve actuation units;

wherein each bank comprises two cylinders, and spacing of the front bank of cylinders is wider than the rear bank of cylinders; and a hydraulic controller positioned inside the frame for regulating hydraulic pressure in the valve rest mechanism, where high hydraulic pressure moves a slide pin in the valve rest mechanism to temporarily rest an associated valve.

* * * * *